US006229480B1

(12) United States Patent
Shintani

(10) Patent No.: US 6,229,480 B1
(45) Date of Patent: May 8, 2001

(54) SYSTEM AND METHOD FOR ALIGNING AN ANTENNA

(75) Inventor: Peter Rae Shintani, San Diego, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/282,696

(22) Filed: Mar. 31, 1999

(51) Int. Cl.[7] ..... H01Q 3/00
(52) U.S. Cl. ..... 342/359; 342/77
(58) Field of Search ..... 342/77, 359; 343/757

(56) References Cited

U.S. PATENT DOCUMENTS 5,043,737 * 8/1991 Dell-Imagine ..... 342/358
5,463,403 * 10/1995 Walker et al. ..... 342/359
5,515,058 * 5/1996 Channey et al. ..... 342/359
5,561,433 * 10/1996 Channey et al. ..... 342/359
5,583,514 * 12/1996 Fulop ..... 342/359
5,589,837 * 12/1996 Soleimani et al. ..... 342/359
5,629,709 * 5/1997 Yamashita ..... 342/359
5,923,288 * 7/1999 Pedlow ..... 342/359
5,940,028 * 8/1999 Iwamura ..... 342/359

* cited by examiner

*Primary Examiner*—Thomas H. Tarcza
*Assistant Examiner*—Dao L. Phan
(74) *Attorney, Agent, or Firm*—Frommer Lawrence & Haug, LLP.; William S. Frommer; Dennis M. Smid

(57) ABSTRACT

A system and method for aligning an antenna. Signals broadcasted over a number of channels for each of a plurality of orientations of the antenna may be received. From such received signals, information pertaining to at least one of (i) an error rate, (ii) a signal level, (iii) equalizer tap coefficients, and (iv) error correction for each orientation of the antenna for each channel is obtained and used to determine an acceptable orientation for the antenna for each channel.

33 Claims, 5 Drawing Sheets

SYSTEM AND METHOD FOR ALIGNING AN ANTENNA

BACKGROUND OF THE INVENTION

The present invention relates to a technique for facilitating the alignment or positioning of an antenna adaptable for receiving transmitted signals.

In an analog broadcasting system (such as that associated with an NTSC TV system or the like), analog television signals may be transmitted and received by a number of television receivers with the use of respective antennas. Each of such antennas may be aligned by moving or rotating the same until an acceptable picture is displayed on the respective television receiver. In such system, a picture signal may be received and the corresponding picture displayed on a respective display screen of the television receiver in real time or substantially real time. As a result, since a picture signal may be received and the corresponding picture displayed on the screen of the television receiver in real time, changes in the displayed picture may be viewed in real time as the respective reception antenna is moved or rotated. Such ability to display pictures and changes thereto in real time enables the optimum or acceptable orientation or alignment of the antenna to be easily found.

In a digital television (DTV) broadcasting system, broadcasted DTV signals may be transmitted from a DTV transmitter directly or by way of a satellite or other type of relaying device(s) for reception by a number of television receivers with the use of antennas. Such broadcasted DTV signals may enable clearer pictures and sound to be produced by the television receivers as compared to those obtained from broadcasted analog television signals (such as those associated with the NTSC TV system). However, in a DTV broadcasting system, it may be difficult to align an antenna so as to properly receive the broadcasted television signals. That is, in a DTV broadcasting system, a picture may be received, processed and displayed wherein such processing could take several seconds or longer. As a result, a delay of several seconds or longer may occur from the time in which the picture signal is received until the corresponding picture is displayed so that a picture signal may not be received and the corresponding picture displayed on the television receiver in real time. Such inability to receive and display in real time may inhibit the finding of the optimum or acceptable orientation or alignment of the antenna.

Further, DTV transmitters may be located on different towers and/or at different locations on the same tower. As a result, a receiving antenna coupled to a user's television receiver may need to be positioned so as to properly receive signals transmitted from such different towers and/or locations. Additionally, even if the DTV transmitters or the antennas thereof are at the same locations but are located at different heights and/or are transmitting at different frequencies, the multipaths may be different thereby necessitating different respective orientations of a user's antenna so as to obtain optimal reception.

The above-mentioned processing delay may be due to the processing performed by the receiver, such as the digital receiver 8 illustrated in FIG. 1. Such digital receiver 8 may include a tuner 10, a demodulator 12, a demultiplexer 14, an audio decoder 16, a video decoder 18, and a microprocessor 20 which may be arranged as shown in FIG. 1. In the receiver 10, a broadcasted DTV signal may be received by the tuner 10 by way of antenna 22. The tuner 10 may include a phase-locked-loop (PLL) circuit. An output from the tuner 10 may be supplied to the demodulator 12 so as to be demodulated. A demodulated signal from the demodulator 12 may be supplied to the demultiplexer 14 so as to be demultiplexed into audio and video signals which may be respectively supplied to audio decoder 16 and video decoder 18. The tuner 10, demodulator 12, demultiplexer 14, and decoders 16 and 18 may be controlled by the microprocessor 20. The processing performed from the tuner 10 to the decoders 16 and 18 may cause the above-mentioned delay of several seconds or longer.

Thus, due to the afore-mentioned processing delay, it may be difficult for a user to adjust the orientation or positioning of an antenna for use in a DTV broadcasting system by using the TV picture as an indicator.

OBJECTS AND SUMMARY OF THE INVENTION

An object of the present invention is to provide a technique for facilitating the alignment of an antenna adaptable for receiving broadcasted DTV signals.

More specifically, it is an object of the present invention to provide a technique for facilitating the alignment of an antenna adaptable for receiving broadcasted DTV signals wherein bit error rate information is utilized to determine an acceptable orientation of the antenna for each of a number of channels and, if the bit error rate information is unavailable, information pertaining to at least one of a signal level, equalizer tap coefficients, and error correction is utilized to determine such acceptable orientation or orientations of the antenna.

A further object of the present invention is to provide a technique as aforesaid wherein information pertaining to the determined acceptable antenna orientation(s) is stored in a memory.

A still further object of the present invention is to provide a technique as aforesaid wherein the antenna orientation information corresponding to a selected channel is read from the memory and either (i) displayed on a screen so that an operator may utilize the same to manually adjust the antenna to the orientation corresponding thereto or (ii) the antenna is automatically aligned in accordance therewith.

In accordance with an aspect of the present invention, a system for aligning a movable antenna is provided. Such system comprises a device for receiving signals broadcasted over at least one channel for each of a plurality of orientations of the antenna; and a device for obtaining from the received broadcasted signals information pertaining to at least one of (i) an error rate, (ii) a signal level, (iii) equalizer tap coefficients, and (iv) error correction for each of the orientations of the antenna for each channel and for determining therefrom an acceptable orientation for the antenna for each channel.

In accordance with another aspect of the present invention, a system for aligning a movable antenna is provided which comprises a device for receiving signals broadcasted over at least one channel for each of a plurality of orientations of the antenna; a device for obtaining from the received broadcasted signals information pertaining to an error rate for each orientation of the antenna for each channel and for determining therefrom an acceptable orientation for the antenna for each channel; and a device, operative when the obtaining device is unable to obtain error rate information, for obtaining from the received broadcasted signals information pertaining to at least one of (i) a signal level, (ii) equalizer tap coefficients, and (iii) error correction for each respective orientation of the antenna for each respective channel and for determining therefrom an acceptable orientation for the antenna for each respective channel.

Other objects, features and advantages according to the present invention will become apparent from the following detailed description of illustrated embodiments when read in conjunction with the accompanying drawings in which corresponding components are identified by the same reference numerals.

DESCRIPTION OF THE PREFERRED EMBODIMENTS

Figure 2:
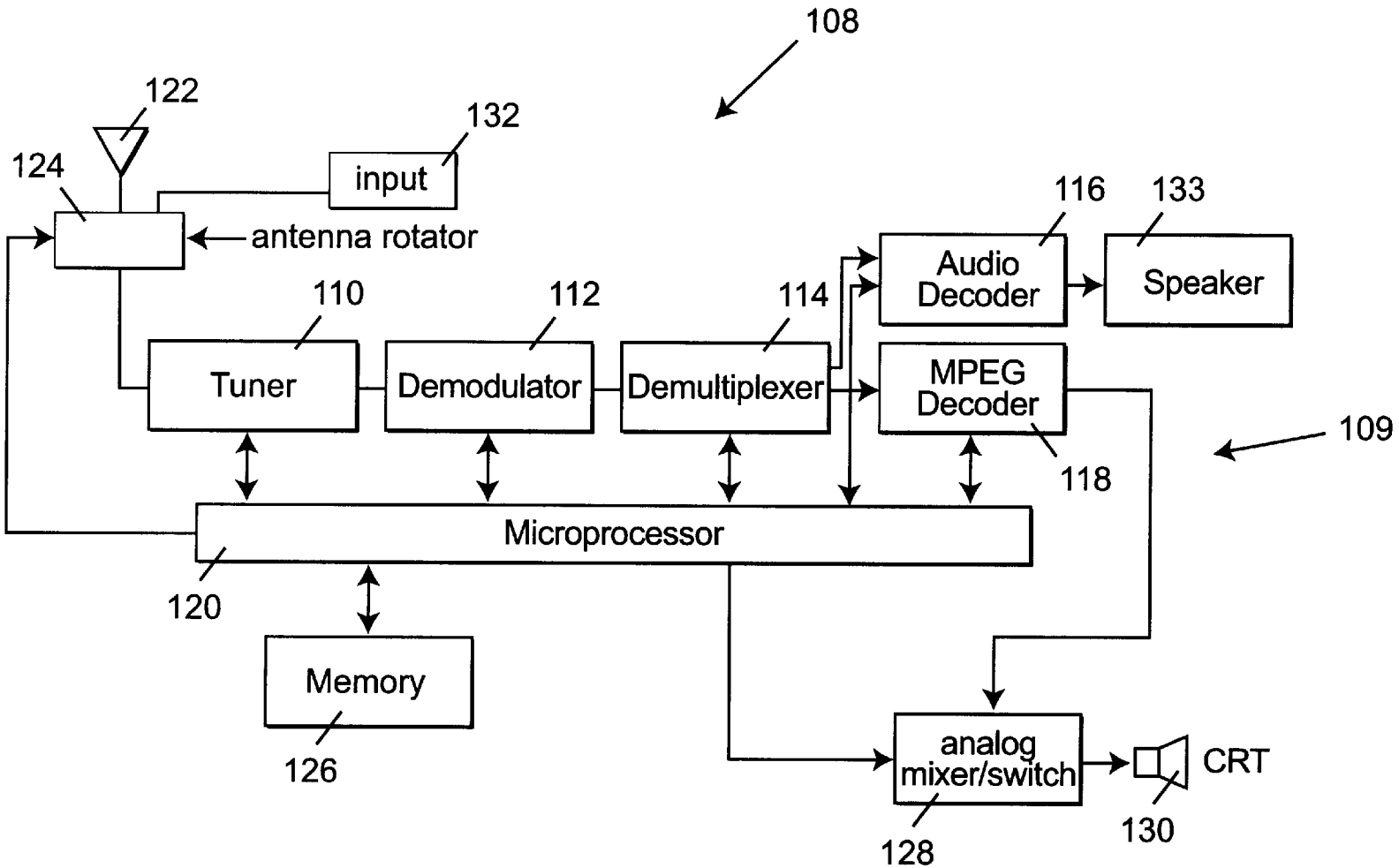
FIG. 2 is a diagram of a system for aligning an antenna according to an embodiment of the present invention.

FIG. 2 illustrates a DTV system 108 in accordance with an embodiment of the present invention. Such system may include an antenna 122, an antenna rotator 124, and a television receiver 109 having a tuner 110, a demodulator 112, a demultiplexer 114, an audio decoder 116, a video decoder 118, a microprocessor 120, and a memory 126 which may be arranged as shown in FIG. 2.

Figure 1:
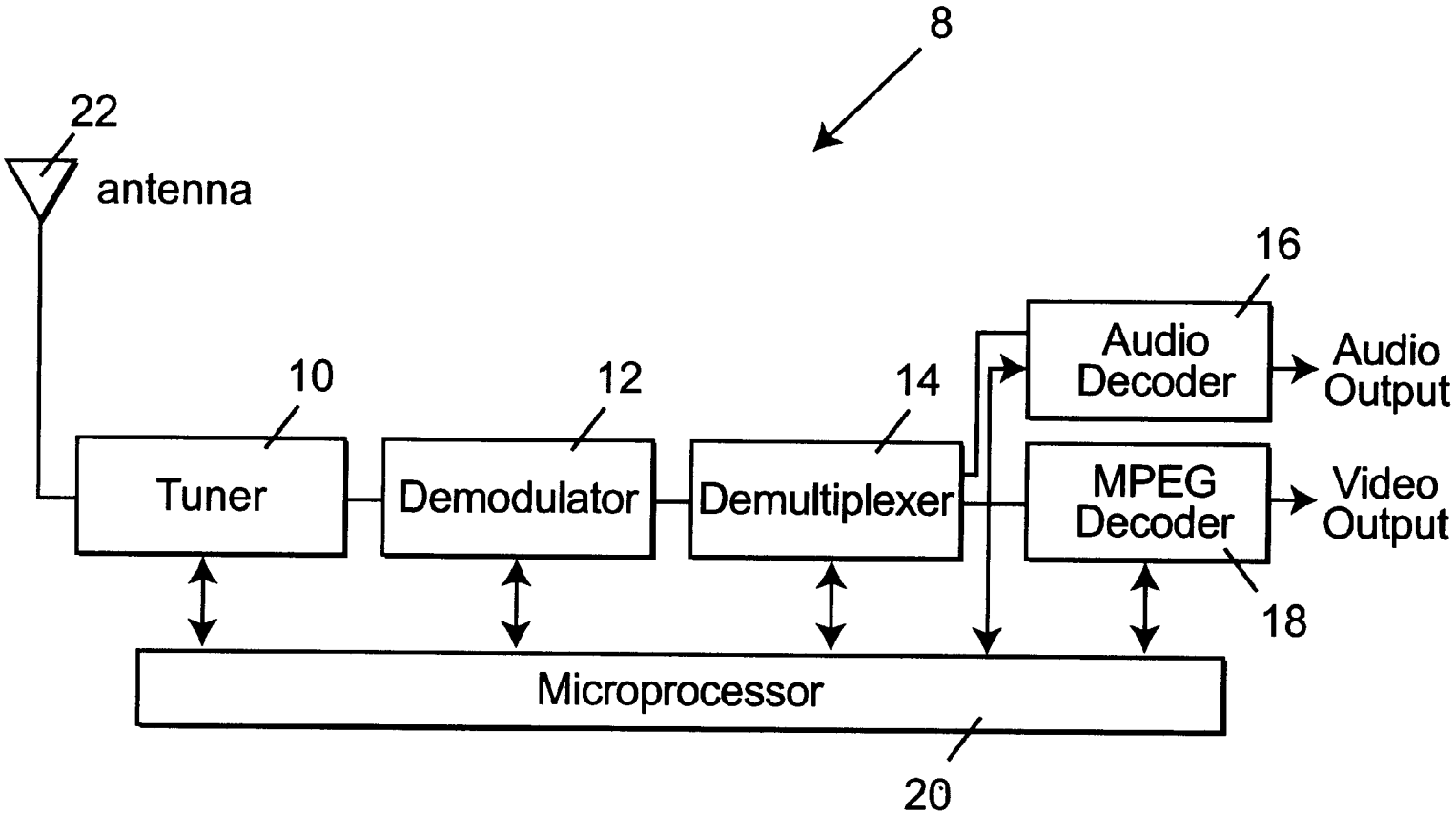
FIG. 1 is a diagram of television receiver.

In a manner similar to that of the receiver 8 described with reference to FIG. 1, in the DTV system 108, a broadcasted DTV signal (such as an 8VSB or vestigal side band signal or a digital modulation broadcast signal) may be received by the tuner 110 by way of antenna 122. The tuner 110 may include a phase-locked-loop (PLL) circuit. An output from the tuner 110 may be supplied to the demodulator 112 so as to be demodulated. A demodulated signal from the demodulator 12 may be supplied to the demultiplexer 114 so as to be demultiplexed into audio and video signals which may be respectively supplied to audio decoder 116 and video decoder 118. The tuner 110, demodulator 112, demultiplexer 114, and decoders 116 and 118 may be controlled by the microprocessor 120.

Unlike the receiver 8, in the DTV system 108, the microprocessor 120 may receive a number of signals from a number of the circuits contained therein and may generate therefrom a control signal or an acceptable antenna orientation signal which is indicative of an optimum or acceptable orientation of the antenna 122 for a respective channel. More specifically, the microprocessor 122 may receive tuning parameters such as automatic gain control (AGC) level information from the tuner 110 and may receive equalizer tap coefficient information, bit error rate (BER) information, error correcting code information (such as that associated with a Reed-Solomon error correction code), carrier-to-noise (C/N) ratio information and so forth from the demodulator 112. From some or all of such received information, the microprocessor 120 may generate an acceptable antenna orientation signal and may supply the same to the memory 126 and/or the microprocessor 120 may generate an antenna rotator control signal and may supply the same to the antenna rotator 124.

The antenna rotator may be coupled to the antenna 122 and the microprocessor 120 and may be adapted to cause the antenna to move or rotate in accordance with an antenna rotator control signal received from the microprocessor. As such, if the antenna rotator control signal indicates that the antenna 122 should be at a particular orientation, then upon receipt of such control signal the antenna is moved so as to be at such position.

An acceptable orientation antenna signal indicative of an acceptable antenna orientation for each channel may be obtained and stored in the memory 126 in a manner more fully described hereinbelow. Such stored acceptable orientation antenna signals may be utilized in positioning the antenna 122 for a respective channel as hereinbelow described.

Upon selection of a desired channel by a user, the microprocessor 120 may cause the acceptable orientation signal corresponding thereto to be read out from the memory 126 and supplied to a display screen or CRT 130 by way of the microprocessor and an analog mixer/switch 128 so as to provide a display indicative of the acceptable orientation to the user. After viewing such display, the user may enter a corresponding command by use of an input device 132 whereupon a corresponding control signal may be generated and supplied to the antenna rotator 124 which, in turn, may cause the antenna 122 to be moved or rotated to the corresponding position. As a result, the antenna 122 may be positioned in the optimum or acceptable orientation for the selected channel.

Alternatively, upon selection of a desired channel by a user, the microprocessor may read the acceptable orientation signal corresponding thereto from the memory 126 and generate therefrom a corresponding antenna rotator control signal and supply the same to the antenna rotator 124. As a result, the antenna 122 may be moved or rotated to the corresponding position. As is to be appreciated, in this situation, the antenna 122 may be automatically positioned in the optimum or acceptable orientation upon selection of a desired channel.

Figure 3:
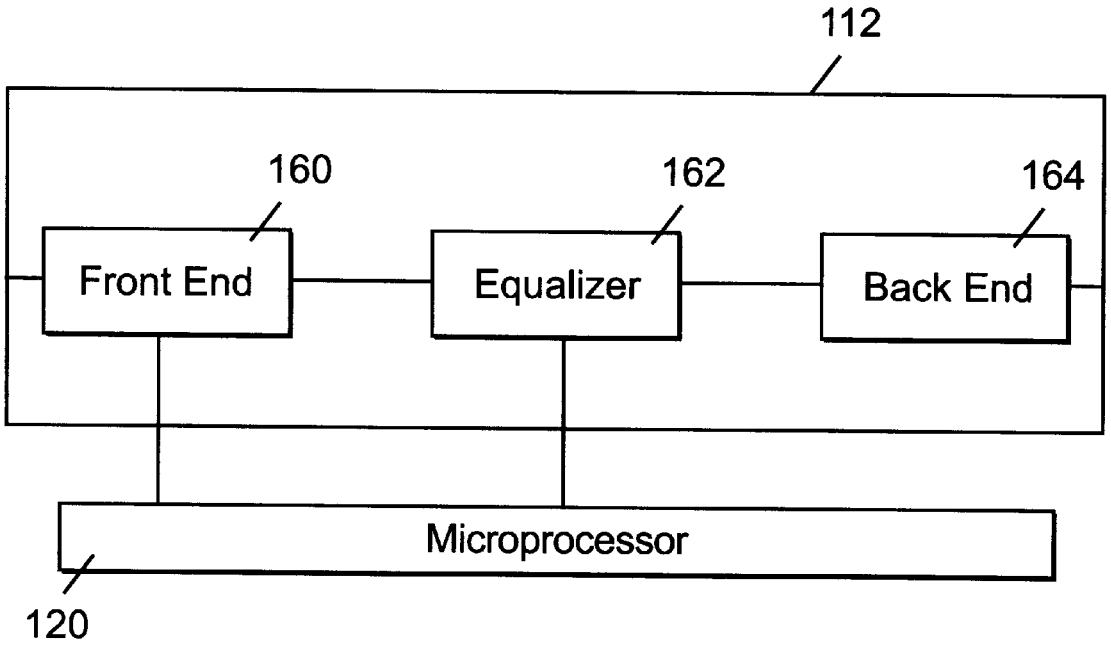
FIG. 3 is a diagram of a demodulator of the system of FIG. 2.

FIG. 3 illustrates the demodulator 112 of the DTV system 108 of FIG. 2. As shown therein, the demodulator 112 may include a front end portion 160, an equalizer 162, and a back end portion 164. Equalizer tap coefficients or information pertaining thereto may be supplied from the equalizer 162 to the microprocessor 120. Information pertaining to BER, C/N, Reed-Solomon error correction codes and so forth may be supplied from the back end to the microprocessor 120.

An operation of the DTV system 108 will now be described.

Figure 4:
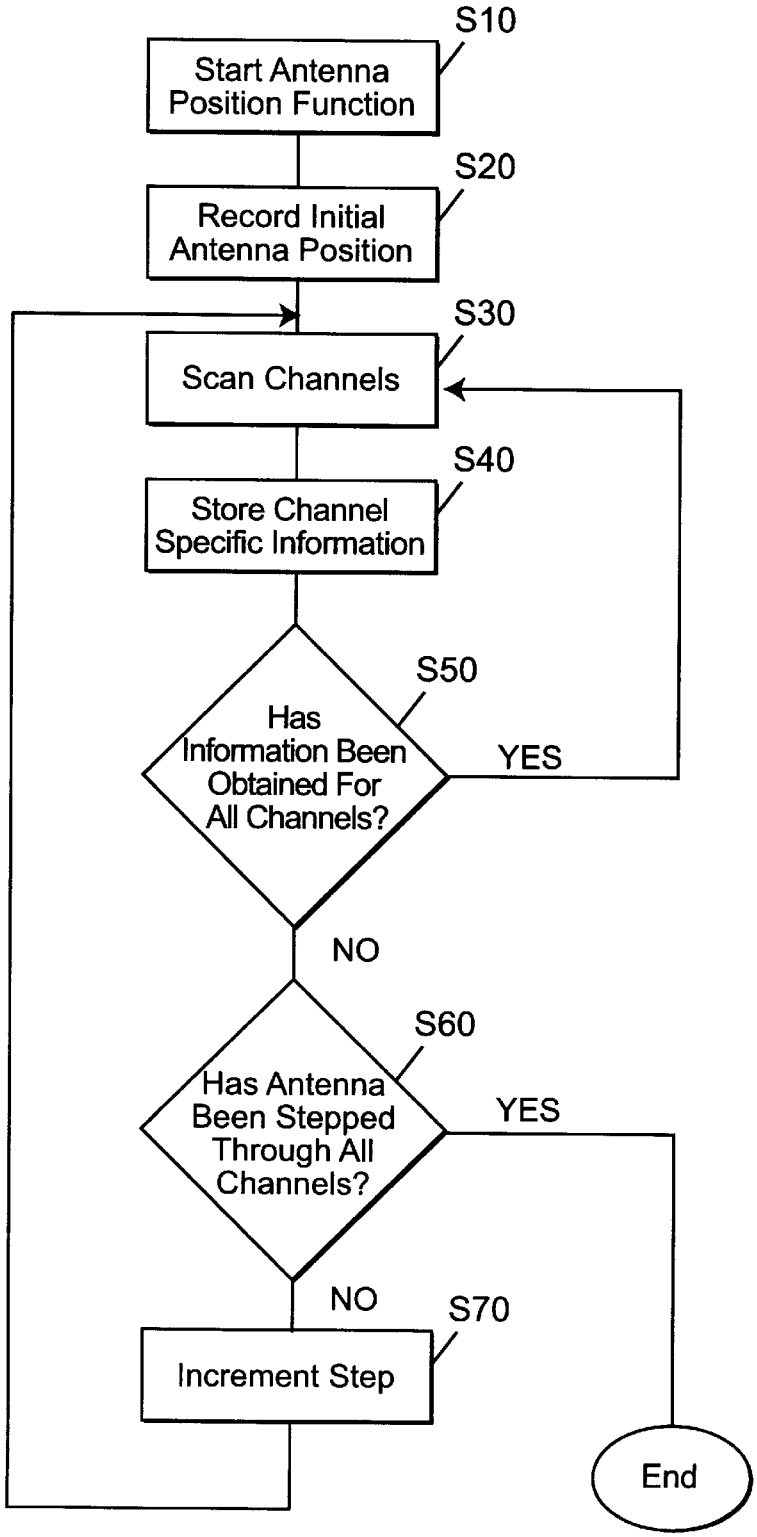
FIG. 4 is a flow chart to which reference will be made in explaining an operation of the present invention.

Initially, acceptable antenna orientation information indicative of the acceptable or optimum orientation of the antenna 122 for each channel is obtained and stored in memory 126. Such initial procedure will now be described with reference to FIG. 4.

An antenna position function may be started in step S10, whereupon the initial antenna position is recorded in step S20. Thereafter, processing proceeds to step S30, whereupon the system 108 scans the channels for a DTV signal. Upon locating a DTV signal, processing proceeds to step S40, whereupon information pertaining to BER, C/N, equalizer tap coefficients, AGC level, Reed-Solomon error correction code and so forth for the respective channel is obtained from the received respective DTV signal by the microprocessor 120 and stored in the memory 136.

Processing then proceeds to step S50, whereupon a determination is made as to whether information pertaining to all of the channels has been obtained. If such determination is affirmative, processing returns to step S30. If, on the other hand, the determination in step S50 is negative, processing proceeds to step S60, whereupon a determination is made as to whether the antenna 122 has been moved throughout all of its available positions. If such determination is affirmative, the initial processing is completed.

Figure 5:
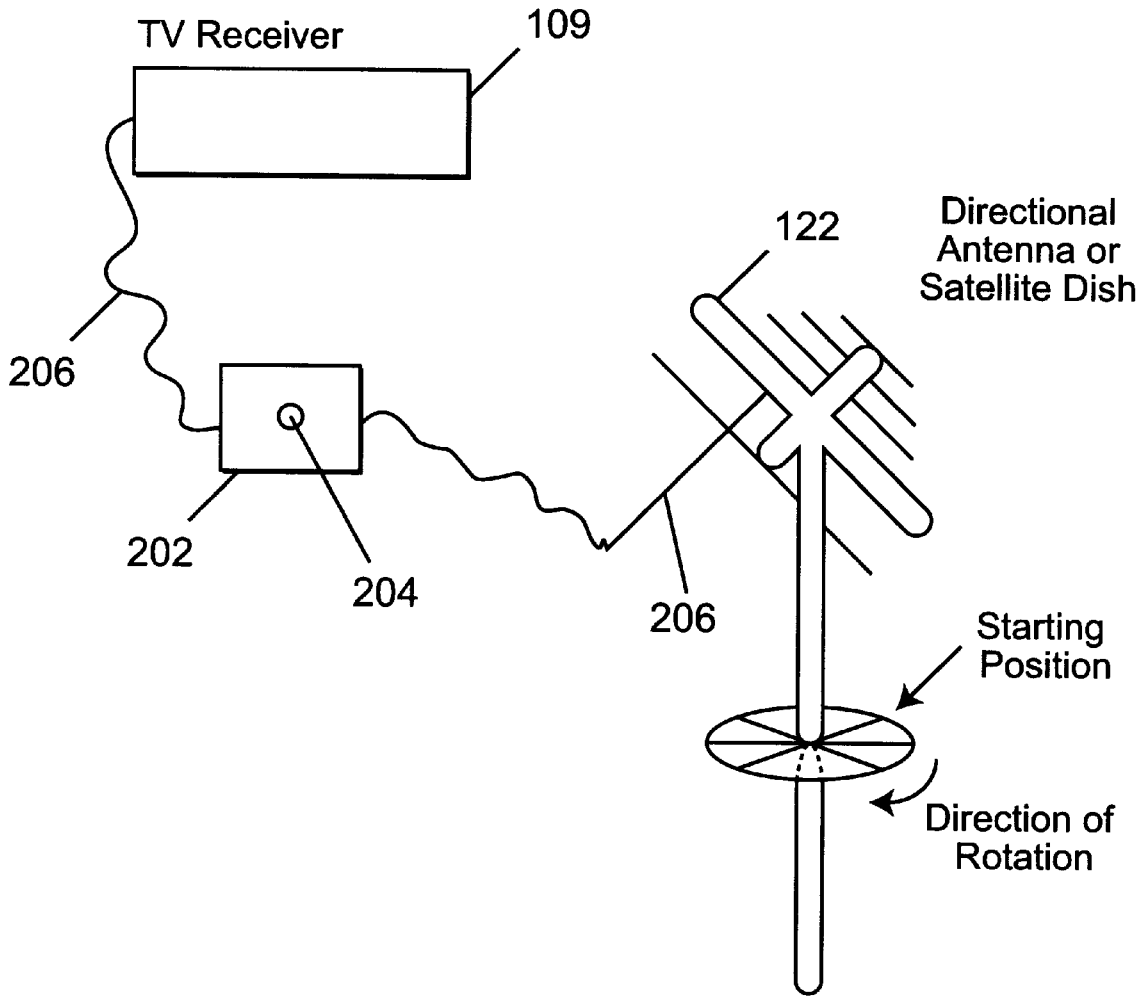
FIG. 5 is a diagram of a modification of the system of FIG. 2.

If, however, the determination of step S60 is negative, processing proceeds to step S70, whereupon an indication is provided to the user to move or rotate the antenna 122 by a predetermined step amount (such as 15 degrees). Such indication may be a visual indication which may be generated by the microprocessor 120 and displayed on the screen 130. Alternatively, such indication may be an audible indication which may be generated by the microprocessor 120 and supplied to a speaker 133 so as to provide an audible sound. As another alternative, an electrical signal may be superimposed on an antenna line 206 (FIG. 5) and supplied to an inline coupler 202, which may be located near the antenna. The inline coupler 202 may remove the superimposed signal and cause a LED 204 to light so as to provide a visual indication to a user to move the antenna 122. In place of such visual display through the use of the LED 204, an audible sound may also be provided through a speaker or the like in the inline coupler 202. As an alternative to providing an indication to the user so that the user may move or rotate the antenna 122 accordingly, the microprocessor 120 may generate an antenna rotator control signal and supply the same to the antenna rotator 124 so as to cause the antenna to be moved to its next position.

After step S70, processing returns to step S30. The processing from step S30 to S70 continues until the antenna 122 has been moved or rotated in all of its available positions (such as every 15 degrees of a 360 degree range).

The microprocessor 120 may then calculate or determine the acceptable or optimum orientation of the antenna 122 for each channel based on the information pertaining to the BER, C/N, equalizer tap coefficients, AGC level, Reed-Solomon error correction code and so forth obtained in step S40. In a preferred embodiment, BER information is utilized to by the microprocessor 120 to determine the optimum orientation of the antenna 122. In this situation, the lowest BER may provide an indication of the optimum antenna orientation. If, however, BER information is unavailable (such as which may occur if the bit error rate is beyond the capability of the system), the microprocessor 120 may determine the optimum orientation of the antenna 122 by use of information pertaining to C/N, AGC level, equalizer tap coefficients, Reed-Solomon error correction code and so forth obtained in step S40. Alternatively, a weighed combination of any two of such items may be utilized by the microprocessor 120 to determine the optimum antenna orientation.

The above-described determinations of the optimum antenna orientations may not be performed in real time.

The optimum antenna orientations for each channel may be stored in a channel map data base in the memory 126.

Upon selection of a desired channel by a user, the microprocessor 120 may cause the optimum or acceptable orientation corresponding thereto to be read out from the data base in the memory 126 and supplied to the display screen 130 thereby providing a display indicative of the acceptable orientation to the user. After viewing such display, the user may enter a command into the input device 132 so as to cause the antenna rotator 124 to move the antenna 122 to the corresponding position, in the manner previously described. Alternatively, upon selection of a desired channel by a user, the microprocessor may read the optimum antenna orientation corresponding thereto from the data base in the memory 126 and generate therefrom a corresponding antenna rotator control signal and supply the same to the antenna rotator 124 so as to cause the antenna 122 to be moved to the corresponding position.

Further, equalizer tap coefficient information may be stored in the channel map data base which may be down loaded to the demodulator 112 to reduce convergence time. Additionally, after information for a respective channel is obtained, if new equalizer tap coefficients are substantially different from the previously stored coefficients, the multipath conditions may have changed. In such situation, the microprocessor 120 may cause an indication of such change to be provided to the user whereupon the user may reconfirm the respective orientation value.

Furthermore, instead of utilizing a mechanical type antenna rotator and a movable antenna, a phase antenna array may be utilized.

Although preferred embodiments of the present invention and modifications thereof have been described in detail herein, it is to be understood that this invention is not limited to these embodiments and modifications, and that other modifications and variations may be effected by one skilled in the art without departing from the spirit and scope of the invention as defined by the appended claims.

What is claimed is:

1. A system for aligning an antenna, said system comprising:

means for receiving signals broadcasted over at least one channel for each of a plurality of orientations of said antenna; and means for obtaining from the received broadcasted signals information pertaining to at least equalizer tap coefficients for each of said orientations of said antenna for each said channel and for determining therefrom an acceptable orientation for said antenna for each said channel.

2. A system according to claim 1, further comprising means for generating an orientation signal representative of the acceptable orientation of said antenna for each said channel and storing each said orientation signal.

3. A system according to claim 2, further comprising means, responsive to a selection of a desired channel, for retrieving the respective stored orientation signal corresponding thereto and means for displaying the retrieved orientation signal.

4. A system according to claim 2, further comprising means, responsive to a selection of a desired channel, for retrieving the respective stored orientation signal corresponding thereto; and means for automatically moving said antenna in accordance with the retrieved orientation signal so as to position said antenna in the respective acceptable orientation for said desired channel.

5. A system according to claim 1, wherein the determining means determines said acceptable orientation for said antenna for a respective channel from a weighted combination of the information pertaining to at least two of an error rate, a signal level, said equalizer tap coefficients, and error correction.

6. A system for aligning an antenna, said system comprising:

means for receiving signals broadcasted over at least one channel for each of a plurality of orientations of said antenna;

means for obtaining from the received broadcasted signals information pertaining to an error rate for each of said orientations of said antenna for each said channel and for determining therefrom an acceptable orientation for said antenna for each said channel; and means, operative when the obtaining means is unable to obtain error rate information, for obtaining from the received broadcasted signals information pertaining to at least one of (i) a signal level, (ii) equalizer tap coefficients, and (iii) error correction for each respective orientation of said antenna for each respective channel and for determining therefrom an acceptable orientation for said antenna for each said respective channel.

7. A system according to claim 6, further comprising means for generating an orientation signal representative of the acceptable orientation of said antenna for each said channel and storing each said orientation signal.

8. A system according to claim 7, further comprising means for selecting a desired channel; means, responsive to the selection of said desired channel, for retrieving the respective stored orientation signal corresponding thereto; and means for displaying the retrieved orientation signal.

9. A system according to claim 7, further comprising means for selecting a desired channel; means, responsive to the selection of said desired channel, for retrieving the respective stored orientation signal corresponding thereto; and means for automatically moving said antenna in accordance with the retrieved orientation signal so as to position said antenna in the respective acceptable orientation for the desired channel.

10. A system according to claim 6, wherein the information pertaining to the equalizer tap coefficients includes the number and value or value of said equalizer tap coefficients.

11. A system according to claim 6, wherein the error correction is a Reed-Solomon type of error correction.

12. A system for aligning an antenna, said system comprising:

a receiving circuit which receives signals broadcasted over at least one channel for each of a plurality of orientations of said antenna; and a circuit including an equalizer and a demodulator which obtains from the received broadcasted signals information pertaining to at least one of (i) an error rate, (ii) a signal level, (iii) equalizer tap coefficients, and (iv) error correction for each of said orientations of said antenna for each said channel; and a microprocessor which calculates from the obtained information an acceptable orientation for said antenna for each said channel.

13. A system according to claim 12, further comprising a memory and wherein the microprocessor generates an orientation signal representative of the acceptable orientation of said antenna for each said channel and causes each said orientation signal to be stored in said memory.

14. A system according to claim 13, further comprising a display unit and wherein the microprocessor, in response to a selection of a desired channel, causes the respective stored orientation signal corresponding thereto to be retrieved from said memory and displayed on the display unit.

15. A system according to claim 13, further comprising a motor device and wherein the microprocessor, in response to a selection of a desired channel, causes the respective stored orientation signal corresponding thereto to be retrieved from said memory and supplied to the motor device so as to automatically move said antenna in accordance therewith to position said antenna in the respective acceptable orientation for said desired channel.

16. A system according to claim 12, wherein said circuit obtains the information from a weighted combination of at least two of said error rate, said signal level, said equalizer tap coefficients, and said error correction and wherein said microprocessor calculates therefrom said acceptable orientation for said antenna for a respective channel.

17. A system for aligning an antenna, said system comprising:

a receiving circuit which receives signals broadcasted over at least one channel for each of a plurality of orientations of said antenna;

a first circuit which obtains from the received broadcasted signals information pertaining to an error rate for each of said orientations of said antenna for each said channel and determines therefrom an acceptable orientation for said antenna for each said channel; and a second circuit, operative when the first circuit is unable to obtain error rate information, to obtain from the received broadcasted signals information pertaining to at least one of (i) a signal level, (ii) equalizer tap coefficients, and (iii) error correction for each respective orientation of said antenna for each said channel and determine therefrom an acceptable orientation for said antenna for each said channel.

18. A system according to claim 17, further comprising a memory and wherein the respective one of the first and second circuits generates an orientation signal representative of the acceptable orientation of said antenna for each said channel and causes each said orientation signal to be stored in said memory.

19. A system according to claim 18, further comprising a display unit and wherein the receiving circuit is operable to select a desired channel and wherein the respective one of the first and second circuits, in response to the selection of said desired channel, causes the respective stored orientation signal corresponding thereto to be retrieved from said memory and displayed on said display unit.

20. A system according to claim 18, further comprising a motor and wherein the receiving circuit selects a desired channel and wherein the respective one of the first and second circuits, in response to the selection of said desired channel, causes the respective stored orientation signal corresponding thereto to be retrieved from said memory and supplied to said motor so as to automatically move said antenna in accordance therewith to position said antenna in the respective acceptable orientation for the desired channel.

21. A system according to claim 17, wherein the information pertaining to the equalizer tap coefficients includes the number and value or value of said equalizer tap coefficients.

22. A system according to claim 17, wherein the error correction is a Reed-Solomon type of error correction.

23. A method for aligning an antenna, said method comprising the steps of:

receiving signals broadcasted over at least one channel for each of a plurality of orientations of said antenna; and obtaining from the received broadcasted signals information pertaining to at least equalizer tap coefficients for each of said orientations of said antenna for each said channel and determining therefrom an acceptable orientation for said antenna for each said channel.

24. A method according to claim 23, further comprising generating an orientation signal representative of the acceptable orientation of said antenna for each said channel and storing each said orientation signal.

25. A method according to claim 24, further comprising retrieving, in response to a selection of a desired channel, the respective stored orientation signal corresponding thereto and displaying the retrieved orientation signal.

26. A method according to claim 24, further comprising retrieving, in response to a selection of a desired channel, the respective stored orientation signal corresponding thereto; and automatically moving said antenna in accordance with the retrieved orientation signal so as to position said antenna in the respective acceptable orientation for said desired channel.

27. A method according to claim 23, wherein the determining step determines said acceptable orientation for said antenna for a respective channel from a weighted combination of the information pertaining to at least two of an error rate, a signal level, said equalizer tap coefficients, and error correction.

28. A method for aligning an antenna, said method comprising the steps of:

receiving signals broadcasted over at least one channel for each of a plurality of orientations of said antenna;

obtaining from the received broadcasted signals information pertaining to an error rate for each of said orientations of said antenna for each said channel and determining therefrom an acceptable orientation for each said channel; and obtaining from the received broadcasted signals information pertaining to at least one of (i) a signal level, (ii) equalizer tap coefficients, and (iii) error correction for each respective orientation of said antenna for each said channel and determining therefrom an acceptable orientation for said antenna for each said channel when the error rate information is unobtainable.

29. A method according to claim 28, further comprising generating an orientation signal representative of the acceptable orientation of said antenna for each said channel and storing each said orientation signal.

30. A method according to claim 29, further comprising selecting a desired channel; retrieving, in response to the selection of said desired channel, the respective stored orientation signal corresponding thereto; and displaying the retrieved orientation signal.

31. A method according to claim 29, further comprising selecting a desired channel; retrieving, in response to the selection of said desired channel, the respective stored orientation signal corresponding thereto; and automatically moving said antenna in accordance with the retrieved orientation signal so as to position said antenna in the respective acceptable orientation for the desired channel.

32. A method according to claim 28, wherein the information pertaining to the equalizer tap coefficients includes the number and value or value of said equalizer tap coefficients.

33. A method according to claim 28, wherein the error correction is a Reed-Solomon type of error correction.

* * * * *